United States Patent [19]

Scherer

[11] Patent Number: 4,815,988

[45] Date of Patent: Mar. 28, 1989

[54] TWO-STEP WIRE CONNECTION AND CUT-OFF TERMINAL

[75] Inventor: Richard J. Scherer, Austin, Tex.

[73] Assignee: Minnesota Mining and Manufacturing Company, St. Paul, Minn.

[21] Appl. No.: 132,214

[22] Filed: Dec. 14, 1987

[51] Int. Cl.[4] ..... H01R 4/24

[52] U.S. Cl. ..... 439/392

[58] Field of Search ..... 439/389, 390, 391, 392, 439/395, 398, 399, 400, 401, 409, 434

[56] References Cited

U.S. PATENT DOCUMENTS

| | | | |
|---|---|---|---|
| 4,431,247 | 2/1984 | Abdullah et al. | 439/392 |
| 4,541,679 | 9/1985 | Fiedler et al. | 439/395 |
| 4,624,518 | 11/1986 | Siedel | 439/400 |
| 4,637,675 | 1/1987 | Loose | 439/391 |
| 4,705,340 | 11/1987 | Loose | 439/395 |

*Primary Examiner*—William R. Briggs

*Attorney, Agent, or Firm*—Donald M. Sell; John C. Barnes

[57] ABSTRACT

An electrical terminal having a supporting body, a tubular contact member having a bifurcate contact element and an elongated perforation generally diametrically aligned therewith, a cap enclosing the contact member with a wire receiving opening aligned with the contact element and an exit opening aligned with the perforation opposite the contact element. Contact is established by twisting the cap in relation to the contact member from a first position to an intermediate position and the wire extending from the exit opening is severed by further twisting of the cap in the same direction until a stop member is engaged.

16 Claims, 4 Drawing Sheets

TWO-STEP WIRE CONNECTION AND CUT-OFF TERMINAL

BACKGROUND OF THE INVENTION

1. Field of the Invention

This invention relates to electrical connectors, and in one particular aspect to a terminal useful at cross connect or serving area exchange points in communications systems, and more particularly to an improved terminal which affords wire connection at the terminal in one step of the operation and will cut the wire during the second step of the operation. Apparatus for the purpose of affording cross connection at area exchange points typically includes terminals for 25 pairs of wires, arranged compactly in an array of rows and columns on a terminal block, for example as described in U.S. Pat. No. 4,431,247.

2. Description of the Prior Art

The existing terminal blocks as described in U.S. Pat. No. 4,431,247 serve to make a wire insulation displacement connection with the wire upon the twisting motion applied to the cap. The conductor to be connected extends through aligned holes in the cap and through an opening in a concentrically arranged stationary contact element which opening leads to an open mouthed wire receiving slot affording an insulation displacement connection (I.D.C.) with the wire of the conductor. The opposite side of the contact has a second opening through which the conductor extends which is initially aligned with a companion second opening in the cap. Turning the cap to make the wire connection forces the wire against the edges of the second opening resulting in the conductor being severed simultaneously with the wire connection or termination being made.

It is often desired to make connection with the contact and yet allow the conductor to extend beyond the terminal. In this instance the simultaneous cutting is undesirable. It is therefore, a feature of the present invention to provide a terminal which will permit tapping into the wire at the terminal and permit the conductor to be joined to another terminal, permanently or temporarily.

Two distinct uses are discovered for the improved terminal which will allow the wire connection to be made in one step and the cutting or severing of the wire if desired in a second step. First, the extended end of the conductor placed through the cap in the terminal will afford temporary connection to the older telephone number assignment when making a connection to a new number. Then, the wire to the older number can be easily removed without another interruption in service to the new number.

Secondly, when making telephone extensions off-premises, a permanent connection featuring one wire will allow connection of the same phone number to two separate structures, such as a house and a garage or other outbuilding, or to an office and a laboratory within a single building.

SUMMARY OF THE INVENTION

An electrical terminal according to the present invention comprises a cylindrical contact member and a cap member rotatable in relationship to the cylindrical member to afford in one step of the rotation an insulation displacement connection to the wire of a conductor and to afford a cutting of the extended end of the conductor during the second step of the rotation. The cylindrical contact member has an open longitudinal seam, transversely slotted from one side of said seam to form and isolate an open mouthed bifurcate insulation displacing contact element, and an elongate perforation opposite said seam to form a wire exit passage. A cap member is rotatably associated with and positioned about the cylindrical member. The cap has an entrance opening in line with the open mouthed bifurcate contact element for receiving a wire and forcing said wire into said contact element and a second exit opening aligned with and adjacent the elongate perforation to allow passage of a wire from the perforation. A support member rotatably supports the cap member in relationship to the cylindrical contact member for twisting movement affording a first step between an in-line position, wherein the openings in the cap are aligned with the mouth to the contact element and the perforation of the cylindrical contact member, to an intermediate insulation displacing connecting position, and through a second step from the intermediate position to a wire severing position.

The cap member is provided with a central column to be disposed, within the cylindrical contact member. The central column has a channel therethrough in line with the mouth of the contact member and the perforation for forcing a conductor into contact with the bifurcate contact element upon rotation of the cap member through the first step. The central column has a peripheral annular wall extending around the interior of the cylindrical contact member. The channel and the exit opening, defined by wall means in the cap surrounding the contact member, is positioned close to the contact member to move the wire in relationship to the perforation, and to force the wire against an edge of the perforation upon rotation of the cap member through the second step from the intermediate position to the severing position.

The contact member is supported on a body member and includes a second wire receiving contact which extends from one end of the contact member through the body member. The body member is also provided with a stop for limiting the extent of rotational movement of the cap member and cooperating detent means for indicating when the cap member has completed the first step, i.e., rotated to the intermediate position. The detent means includes associated members on the cap and body member to provide at least a physical indication that the point in the rotation has been reached or an audible indication. The cap member may be provided with visible markings to indicate when the cap has been rotated through the first step.

The peripheral extent of the perforation in the contact member is equal to or greater than the extent of angular rotation to move said cap member to the first step, from the first position to the intermediate position. The angular extent of the perforation however is less than the angular extent of rotation through both steps to afford cutting of the conductor against one end of the perforation when driven thereagainst by the walls defining the channel and the exit opening in the cap.

BRIEF DESCRIPTION OF THE DRAWING

The present invention will be further described with reference to the accompanying drawing wherein.

DESCRIPTION OF THE PREFERRED EMBODIMENT

Figure 1:
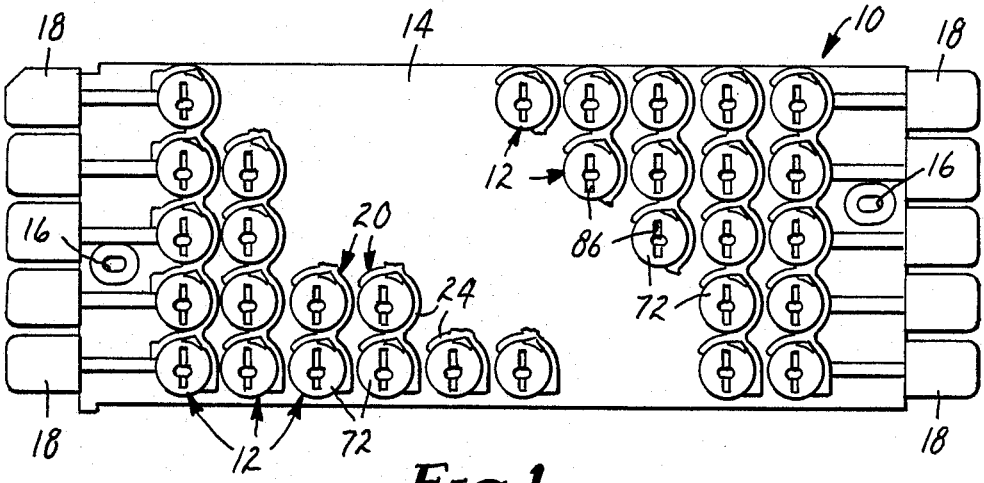
FIG. 1 is a plan view of a cross connect module comprising the terminals of the invention.
Figure 3:
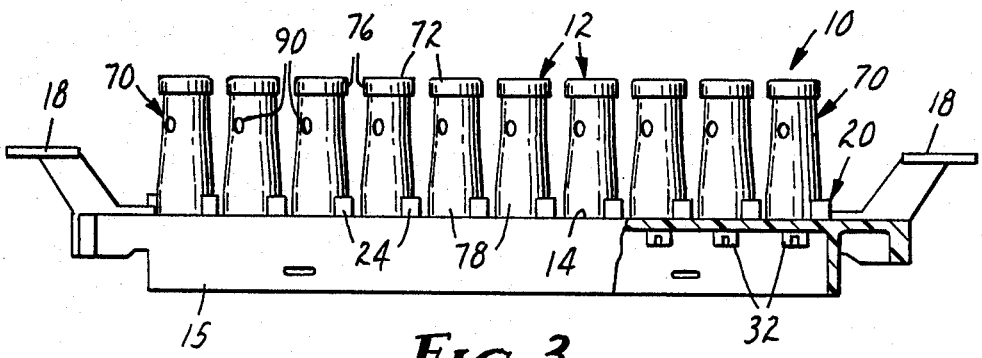
FIG. 3 is a side elevation, with a portion cut away, of the module of FIG. 1.
Figure 2:
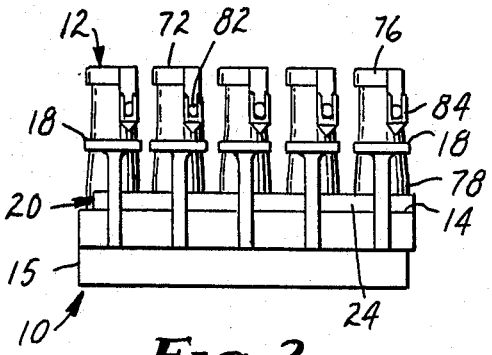
FIG. 2 is an end elevation.

The module 10 of FIGS. 1–3 will be seen to include a plurality of separate terminals 12, e.g. 50 terminals disposed in five rows and ten columns. A module is illustrated in U.S. Pat. No. 4,431,247 which has a base and arrangement of terminals generally similar to that of the module described herein. The base 14, having lower walls 15, is dimensioned for mounting against a support within a cabinet by means of screws inserted through holes 16. Pads 18 at the ends of the base are provided for supporting and arranging individual wires or bundles of wires which are to be connected. Color coding of the terminals is customarily added for ease of identification of tip and ring positions.

Figure 7:
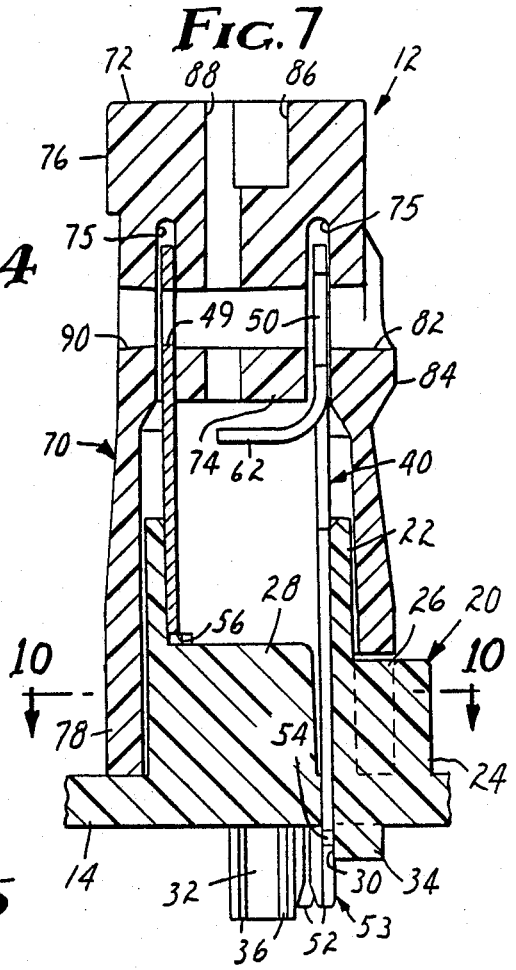
FIG. 7 is a longitudinal cross section of the assembled terminal of FIGS. 4–6 taken approximately at section 7—7 of FIGS. 4–6.
Figure 11:
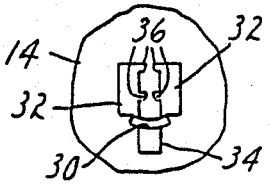
FIG. 11 is a bottom view of the body of FIG. 6.

The terminal 12 includes a body 20, FIG. 7, formed as a part of the base 14. It consists of a cup shaped segment 22 having a slightly conical outer upper surface and which is surrounded partially by a crecent-like wall 24, the two of which are joined by a stop 26 and are spaced apart to receive the base of a cap member 70, to be hereinafter described. The stop 26 extends upwardly from the base 14, and a detent 28, see FIG. 7, protrudes inwardly from the opposite lower inner surface. The bottom of the cup, forming a portion of the base 14, is perforate at arcuate perforation 30 and carries raised blocks 32 and 34 on the outer surface. Blocks 32 include opposing extensions 36, see FIGS. 7 and 11, which extensions define a wire retaining pathway in alignment with the center of the arcuate perforation 30.

Figure 5:
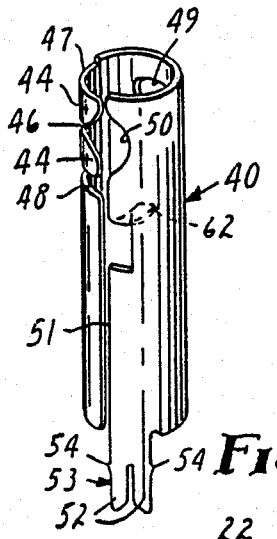
Figure 6:
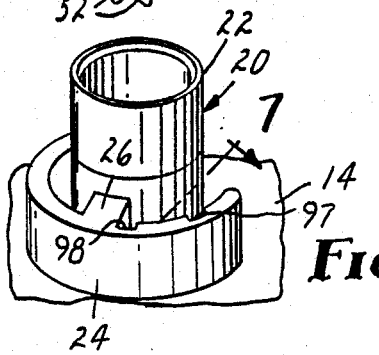
Figure 8:
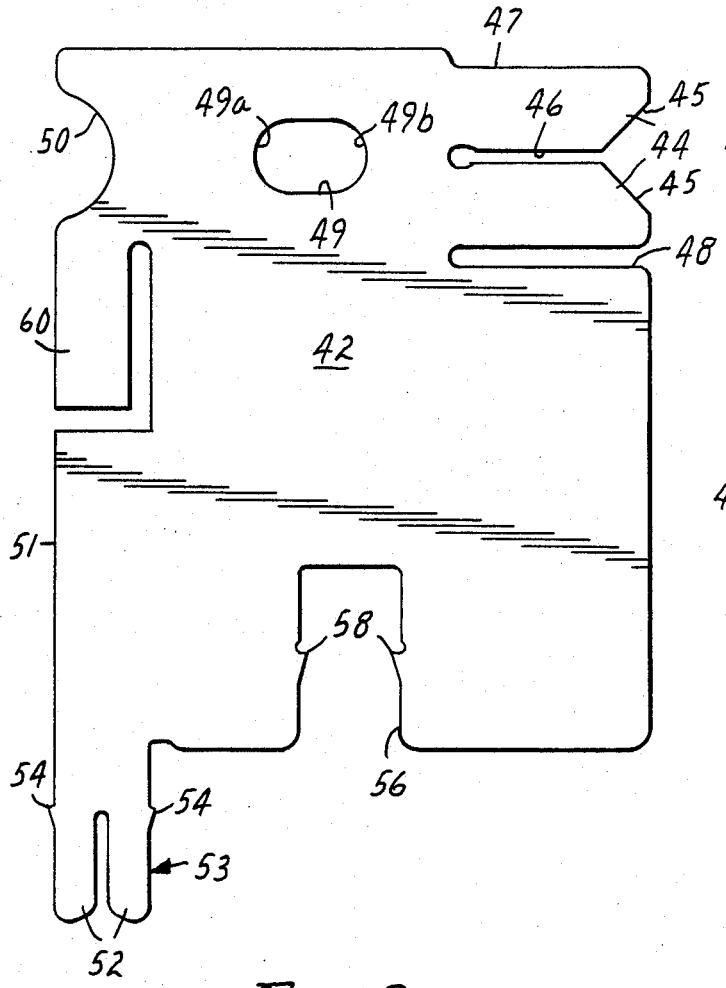
FIG. 8 is a plan view of the blank for the contact element of FIG. 5.
Figure 9:
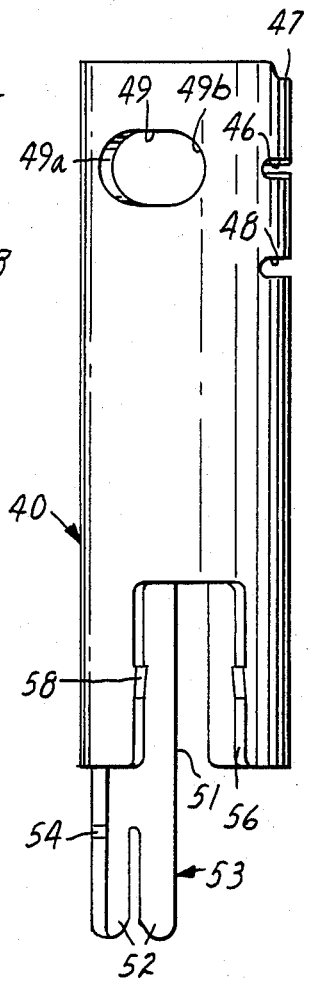
FIG. 9 is a side view of the contact element rotated about 120 degrees clockwise from the view of FIG. 5.

The tubular or generally cylindrical contact member 40 of FIG. 5 is formed from a flat blank 42 as shown in FIG. 8. It has a pair of laterally directed contact fingers 44 defining an open mouthed wire receiving slot 46 adapted to receive one or more sizes of wire used in the communications industry. A marginal space or partial slot 47 above, and a second slot 48 below, serve to isolate the resulting bifurcate contact element and to permit necessary slight deflection of the contact fingers during insertion of a conductor in slot 46 to make an insulation displacing wire connection with the contact member.

An enlarge perforation 49, illustrated as elongate, is disposed in the blank and aligned with the slot 46 to be disposed generally diametrically opposite thereof when the blank is formed into the generally cylindrical connecting member 40. One edge 49*a* of the perforation is generally diametrical of an arcuate edge wall defining a semicircular concavity 50 formed along an edge 51 forming the seam of the contact member 40. An opposite edge 49*b* of the perforation 49 will be disposed generally diametrically opposite an area intermediate the length of the slot 46. The perforation 49, together with the open mouth of the connecting member 40 between the angled inner edges 45 at the tips of fingers 44, form a transverse passageway for a wire generally diametrically through the tubular connecting member 40. The size of the perforation 49 is such that a wire may freely pass therethrough when in the open mouthed area of the connecting member 40, between concavity 50 and walls or edges 45, and when the wire is forced into the slot 46 and the cap has been twisted to the intermediate position.

A second pair of contact fingers 52 depending from the lower edge of the member 40 and forming an extended second bifurcate contact element 53 extends through the arcuate opening 30 in the base and against and beyond the block 34. Angular projections 54 on the longitudinal edges of the extension penetrate the walls of the opening 30 and anchor the member 40 to the base.

The member 40 is further slotted from the lower edge to form a wide slot 56. The side edges defining the slot carry angular anchor projections 58. The inner detent 28 of the body 20 fits snugly within the slot 56 and prevents rotation of the connecting member 40 in relationship to the body. The projections 58 penetrate the edges of the detent 28 and assist in anchoring the member against removal.

A tongue 60 forming a part of the edge of the blank 42 beneath the concavity 50 is bent inwardly to form contact tab 62 extending horizontally across the center of the cylindrical connecting member 40, as shown in FIG. 7.

The cap 70 is also generally cylindrical, with a top wall 72 from which depends a center column 74 difining a circular wall segment, leaving an annular space 75 between the wall of column 74 and the annular wall positioned about the contact member. The cap fits over the upper portion of the tubular member 40, which member 40 extends into the annular space 75, and over the tubular shell 22 of the cup shaped segment of the body 20 to a position adjacent to the base 14. Upper and lower portions 76, 78 of the cap are radially enlarged for increased strength. A segment of the lower portion is omitted, leaving a space 80 which permits the cap to fit over the stop 26 on the body 20 and to be rotated thereon through approximately one quarter turn.

The cap, including the center column 74, is laterally perforate at the level of the transverse passageway in the member 40, to provide a wire receiving channel 82. The outer surface of the cap is enlarged and chamfered below the entrance to this channel, as at boss 84, so as to facilitate the insertion of a wire end into the channel.

The top of the cap is slotted and perforate. As illustrated in FIG. 1, the slot 86 is in line with the column transverse to the base 14 when the connector is open to receive a wire end, with the left edge of the lower cap portion 78 against the stop 26. The perforation 88 is parallel to and closely adjacent the longitudinal axis; it extends through the top wall 72 and in line with the contact tab 62. An exit opening 90 in the cap 70 allows the conductor to pass through the perforation 49 and the opposite side of the cap.

The cap 70 is provided with a detent means cooperating with a stationary portion of the terminal to provide a physical and/or an audible indication that the cap has been rotated through an arc which moves the cap from a first position with the left edge of the space 80 against the stop 26 to an intermediate position where a wire in the channel 82 and open-mouthed area of the connecting member 40 will be forced into a wire connecting position in the slot 46. From this intermediate position the cap can be rotated in either direction, but continued rotation in the clockwise direction will drive the wire against the edge 49*a* to cut the extented end of the wire at the perforation. The further rotation moves the right edge of the space 80 of the cap against the stop 26 and the cut end of the connected wire is trapped between the wall segment 74 of the cap and the connecting member.

Figure 4:
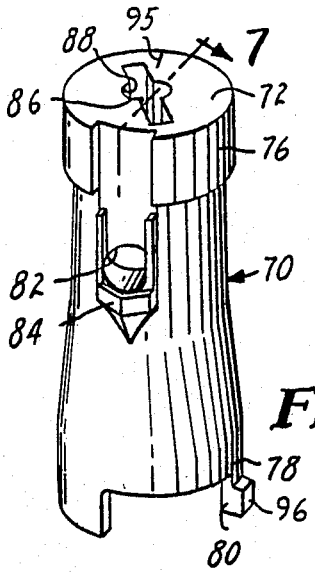
FIGS. 4, 5, and 6 are perspective views, in axial alignment, of the cap, the contact element, and body respectively of one of the terminals of the module of FIG. 1.

Alternatively, the position of the cap, such as the top of the cap may be provided means offording a visual indication of a line 95 as indicated on the top wall 72 of the cap in FIG. 4 which will indicate the rotation of the cap between 45 and 60 degrees, giving a visual indication of the intermediate position.

Figure 10:
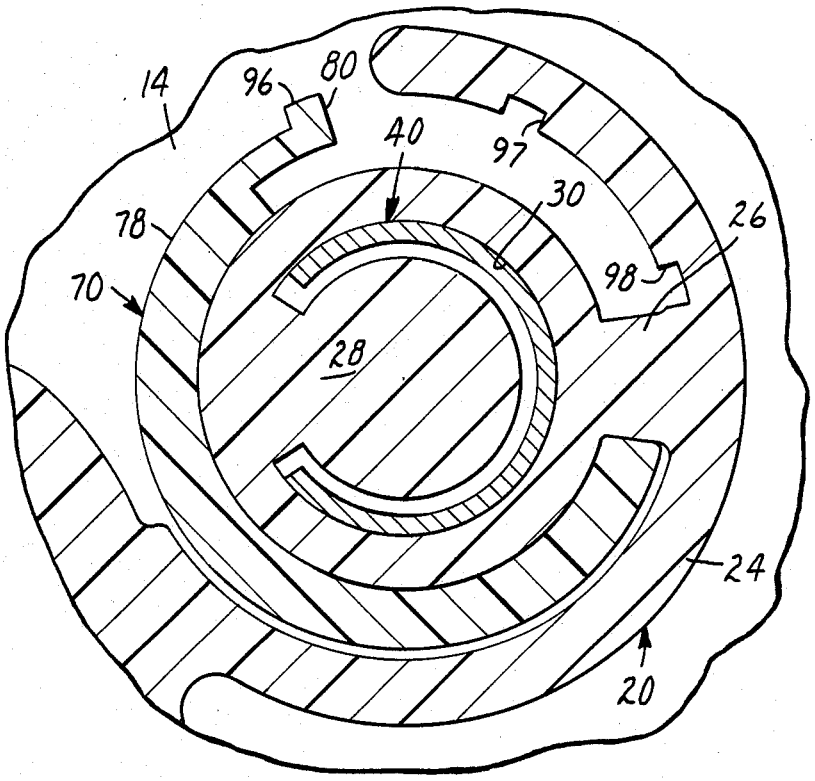
FIG. 10, is a sectional view taken along the line 10—10 of FIG. 7.

As illustrated in FIG. 10, the detent means comprises a projection 96 formed on the lower edge of the cap 70 which projects radially outwardly. The projection 96 projects to a position to interfere with the wall 24 which deflects the projection inward upon rotation of the cap 70 clockwise as shown in FIG. 10 until it reaches a first recess 97 indicating the cap has reached the intermediate position. Further rotation to complete generally a quarter of a turn places the projection 96 in a second recess 98 and a wall defining the space 80 contacts the stop 26.

In operation, cross connect wires are connected to the individual terminals by inserting the wire in and through the channel 82 and twisting the cap through the arc until the wire is forced between the fingers 44 which displace the insulation and make spring compression reserve contact with the conductor. The remaining free end extends through perforation 49 and the exit opening 90. Twisting action is accomplished with an ordinary screwdriver, the bit fitting into the slot 86. The projection 96 enters the recess 97, causing a noise and resistance to further rotation. At this point the wire has made electrical insulation displacing connection to the tubular connecting member 40. The extended end of the wire that may also extend to another terminal has not been severed. When termination is desired at the terminal 12 the cap may then be rotated to the limit permitted by the stop 26. If electrical contact with the terminal is desired, as for testing purposes, the aperture 88 provides for access of a suitable test probe to the tab 62.

The combination of cap 70 and contact member 40 is generally useful in the connector and terminal art, but offers particular advantages when incorporated in multiple terminal arrays as shown in FIG. 1 and which are offered in partly prewired or preterminated condition as will now be described.

With the structure shown in FIGS. 1 through 3 and 11, wire segments are forced into the contacts 53 and between opposing extensions 36, using a suitable insertion tool. Any excess of wire is simultaneously cut off by knife action of the tool against the block 34. Somewhat analogous tool design and action is shown in U.S. Pat. No. 4,210,378. The free ends of the wire segments are bundled together, and the connections are sealed in place by embedding with a suitable sealant applied over the bottom surface of the base 14 and at least partially filling the space defined by the walls 15.

Pretermination may also be accomplished during assembly of the terminals. A wire segment is forced into position against the lower surface of the base 14, within the channel between the blocks 32 and extensions 36, and across the arcuate perforation 30, and held in place with a supporting jig while the connecting member 40 is inserted through the body 20. The several wires are then bundled and the connections embedded as already described.

Having thus described the invention with reference to the preferred embodiments, it is to be understood that changes may be made in the terminal without departing from the present invention as defined by the appended claims.

I claim:

1. An electrical terminal comprising:

a cylindrical contact member having an open longitudinal seam, transversely slotted from one side of said seam to form and isolate an open mouthed bifurcate insulation displacing contact element, and having a perforation opposite said seam to form a wire exit passage;

a cap member rotatably associated with said cylindrical contact member, said cap member having a channel in line with said open mouthed bifurcate contact element for receiving a wire and forcing said wire into said contact element and aligned with said perforation to allow passage of a said wire from said perforation, and support means for rotatably supporting said cap member in relationship to said cylindrical contact member for movement and including means for defining a first in-line position, an intermediate insulation displacing connecting position, and a wire severing position.

2. A terminal according to claim 1 wherein said cap member is provided with an annular wall disposed about said cylindrical contact member and coaxial therewith, said annular wall having an opening in line with said channel to assist in forcing a said wire into contact with said bifurcate contact element upon rotation of said cap member from said first position to said intermediate position.

3. A terminal according to claim 2 wherein said annular wall extends around said cylindrical member and has a second exit opening for engaging a said wire to move the same in relationship to said perforation, and to force a said wire against an edge of said perforation upon rotation of said cap member from said intermediate position to said severing position.

4. A terminal according to claim 1 wherein said support means includes stop means for limiting the extent of rotational movement of said cap member and cooperating detent means for indicating when said cap member has rotated to said intermediate position.

5. An electrical terminal comprising:

a cylindrical contact member having an open longitudinal seam, transversely slotted from one side of said seam to form and isolate an open mouthed bifurcate insulation displacing contact element, and having a perforation opposite said seam to form a wire exit passage;

a cap member rotatably associated with and positioned about said cylindrical member, said cap member having an entrance opening in line with said open mouthed bifurcate contact element for receiving a wire and forcing said wire into said contact element and a second exit opening aligned with and adjacent said perforation to allow passage of a said wire from said perforation, and support means for rotatably supporting said cap member in relationship to said cylindrical member for movement nd including means for defining a first in-line position, an intermediate insulation displacing connecting position, and a wire severing position.

6. A terminal according to claim 5 wherein said cap member is provided with an annular wall disposed within said cap member which is coaxial therewith to be disposed within said cylindrical contact member, said annular wall having an opening in line with said entrance opening to assist in forcing a said wire into contact with said bifurcate contact element upon rotation of said cap member from said first position to said intermediate position.

7. A terminal according to claim 5 wherein said cap member has a central column disposed within the interior of said cylindrical member which central column has a channel therein aligned with said exit opening, said channel and said exit opening being defined by wall means for engaging a said wire to move the same in relationship to said perforation, and to force a said wire against an end of said perforation upon rotation of said cap member from said intermediate position to said severing position.

8. A terminal according to claim 5 wherein said support means includes stop means for limiting the extent of rotational movement of said cap member and cooperating detent means for indicating when said cap member has rotated to said intermediate position.

9. A terminal according to claim 8 wherein said cap member and said support means have cooperating means for producing an audible sound when said cap member has reached said intermediate position.

10. A terminal according to claim 8 wherein said detent means affords increased resistance to rotational movement of said cap member when said cap member is rotated to said intermediate position.

11. A terminal according to claim 8 wherein said perforation has an angular extent equal to or greater than the extent of angular rotation to move said cap member from said first position to said intermediate position.

12. A terminal according to claim 8 wherein said perforation has an angular extent greater than the angular extent of rotation of said cap member between said first position and said intermediate position and less than the angular rotation of said cap member between said first position and said severing position.

13. A terminal according to claim 5 wherein said perforation is an elongate opening extending about the periphery of the cylindrical contact member, said angular extent being equal or greater than the extent of angular rotation to move said cap member from said first position to said intermediate position.

14. A terminal according to claim 5 wherein said perforation is an elongate opening extending about the periphery of the cylindrical contact member to an angular extent greater than the angular extent of rotation of said cap member between said first position and said intermediate position and less than the angular rotation of said cap member between said first position and said severing position.

15. A terminal according to claim 1 wherein said cap member has a visual indicating means thereon to indicate the position of the cap member with respect to said first position, said intermediate position and said severing position.

16. A terminal according to claim 5 wherein said cap member has a visual indicating means thereon to indicate the position of the cap member with respect to said first position, said intermediate position and said severing position.

* * * * *